US006101786A

United States Patent [19]

Lees

[11] Patent Number: 6,101,786

[45] Date of Patent: Aug. 15, 2000

[54] FILLING MACHINE

[75] Inventor: John Lees, Minneapolis, Minn.

[73] Assignee: Tetra Laval Holdings & Finance, SA, Pully, Switzerland

[21] Appl. No.: 09/141,695

[22] Filed: Aug. 28, 1998

[51] Int. Cl.[7] ..... B65B 55/04

[52] U.S. Cl. ..... 53/167; 53/565

[58] Field of Search ..... 53/167, 425, 426, 53/565

[56] References Cited

U.S. PATENT DOCUMENTS

| | | | |
|---|---|---|---|
| 3,120,089 | 2/1964 | Monroe et al. | 53/565 |
| 3,314,216 | 4/1967 | Fitzwater | 53/565 |
| 3,566,762 | 3/1971 | Vadas et al. | 53/370.9 X |
| 3,579,958 | 5/1971 | Hentges et al. . | |
| 3,599,391 | 8/1971 | Allen et al. | 53/167 |
| 3,918,236 | 11/1975 | Allen | 53/284.5 X |
| 4,566,251 | 1/1986 | Spisak et al. | 53/565 X |
| 4,580,392 | 4/1986 | Lagerstedt et al. | 53/552 X |
| 4,590,734 | 5/1986 | Veda | 53/167 X |
| 4,590,740 | 5/1986 | Rodocker | 53/565 X |
| 4,683,701 | 8/1987 | Rangwala et al. | 53/426 X |
| 4,944,132 | 7/1990 | Carlsson et al. | 53/167 |
| 5,027,585 | 7/1991 | Russell et al. . | |
| 5,122,340 | 6/1992 | Shimamura et al. | 53/425 X |
| 5,488,812 | 2/1996 | Stark et al. | 53/565 X |

*Primary Examiner*—Daniel B. Moon
*Attorney, Agent, or Firm*—Welsh & Katz, Ltd.

[57] ABSTRACT

A packaging machine for processing a carton blank received from a magazine into a formed, filled and sealed carton package. The packaging machine includes an infeed sterilizer mechanism, a carton lift, a form and fill carousel and a sealing mechanism. The infeed sterilizer sterilizes an erected carton blank having an open top end and an open bottom end, and is disposed on a first level of the packaging machine. The carton lift lifts sterilized cartons from the infeed sterilizer mechanism on the first level to a second level. The form and fill carousel is located on the second level and has a central turret with a plurality of filling mandrels connected thereto. Each of the filling mandrels is in flow communication with a product supply and fills the carton as it is lowered for sealing. The sealing jaw mechanism is disposed to receive a filled carton from a mandrel on the form and fill carousel and to seal an open end of the carton.

9 Claims, 9 Drawing Sheets

FILLING MACHINE

CROSS REFERENCES TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to filling machines. Specifically, the present invention relates to a packaging machine for forming, filling and sealing a carton from a blank.

2. Description of the Related Art

Milk or juice is often packaged in containers that have been sterilized to prolong shelf life of the contents under refrigeration. When milk or juice is being packaged under aseptic packaging conditions, the contents are capable of being stored for a substantial period of time at room temperature without spoilage. Such packaging processes require effective sterilization of the packaging material prior to filling of a container formed from the packaging material. For example, a container, such as a gable-top carton, that has previously been partially formed may have its interior surfaces sterilized prior to being filled with product. U.S. Pat. No. 4,375,145, discloses a packaging machine having a conveyor on which pre-formed cartons advance under ultraviolet germicidal solution, such as hydrogen peroxide, passing under the ultraviolet lamps.

A popular type of packaged product is an Extended Shelf Life ("ESL") packaged product due to the added value such a filled container presents to a retailer. For example, pasteurized milk processed and packaged under typical conditions has a shelf life at four degrees Celsius of seven to fourteen days while the same milk processed and packaged under ESL conditions has a shelf life of fourteen to sixty days. Under ESL conditions, juice may have a shelf life of forty to one-hundred twenty days, liquid eggs sixty to ninety days, and eggnog forty-five to sixty days. Thus, ESL packaging greatly enhances a product since it extends the time period that the particular product may be offered for sale to the consuming public. In order to have ESL filling, the filling system should be kept sterile in order to prevent contamination of the product or container during filling on a form, fill and seal package machine.

Many ESL machines use UV light and hydrogen peroxide. However, UV lamps greatly increase the price of a packaging machine and require extensive monitoring and maintenance to operate properly.

Another problem with current sterilization practices is the limitation of concentration of hydrogen peroxide that may be used on packaging material for food. Only a minute quantity of hydrogen peroxide residue may be found on the packaging that limits most applications to less than 1% concentration, and requiring UV light. However, as mentioned above, UV lamps and associated components are very expensive and require more maintenance and energy than machines without UV lamps.

Another popular type of packaged product is an aseptic packaged product due to the tremendous value such a filled container presents to a retailer. For example, ultra high temperature processed milk may have a non-refrigerated shelf life of over one-year in a TETRA BRIK® Aseptic package. Such a package is fabricated from a web of packaging material on a vertical form, fill and seal packaging machine that is substantially enclosed except for an outlet for the final package. It is quite apparent that producing a package capable of non-refrigerated distribution is highly desirable, however, the packaging machine must be substantially enclosed to prevent any and all contamination of the product, the machine or the packaging material.

In the area of aseptic linear form, fill and seal packaging machines, wherein a series of container blanks are utilized instead of a web of packaging material, the maintenance of the entire machine in a non-contaminated enclosed environment is highly critical. One such machine is disclosed in U.S. Pat. No. 5,660,100 wherein a preheating zone, a sterilizing zone, a drying zone, a filling zone and a closure zone are all enclosed within a single sterile space that optimizes hermeticity. A hydrogen peroxide aerosol or liquid is utilized to sterilize the packages and the enclosure. As is apparent, the hermetically sealed environment is the most important factor in maintaining the aseptic environment. Such an environment increases the price of the machine and requires substantial maintenance.

Another machine is disclosed in U.S. Pat. No. 4,992,247 wherein a container sterilization system is adaptable to a form, fill and seal machine. The system is a closed loop system having a chamber, a blower for directing a mixture of air, vaporized hydrogen peroxide and vaporized water through ductwork and to a vapor delivery inlet manifold disposed above a line of conveyors conveyed therethrough the system. An exhaust manifold is positioned below the containers to receive the mixture. An iso-box is positioned at the front of the inlet manifold to serve as an air lock or curtain to prevent outside contaminants from entering the chamber and to prevent vaporized hydrogen peroxide from leaving the chamber. Containers enter the iso-box before entering the chamber. In the chamber, hydrogen peroxide condenses on the inner surfaces of each of the containers prior to exiting through another iso-box. As each container moves through the chamber, liquid hydrogen peroxide condenses on inner surfaces and eventually equilibrium is reached between the liquid and vapor hydrogen peroxide. The pre-heating temperatures and the processing temperatures are controlled to maintain the sterilizing effect. After the iso-box is a drying air inlet manifold having heated air flowing from a HEPA filter. Although U.S. Pat. No. 4,992,247 discloses that the system is positioned between a bottom forming station and a top sealing station, it is assumed that a filling station is disposed adjacent the drying manifold. It is important in U.S. Pat. No. 4,992,247 that the hydrogen peroxide condense on the containers in order to have the desired "scrubbing" effect.

An ESL machine is capable of producing a large number of containers per hour of operation and allows for an "open" operating environment as compared to an aseptic machine that requires a substantially enclosed environment for most of the machine to prevent contamination of the packaging material, product and machinery. However, the aseptic container is capable of non-refrigerated storage for long periods of time. In the sterilized package stage, positioned between ESL packages and aseptic packages, are high acid ambient distribution ("HAAD") packages. The HAAD package is capable of non-refrigerated storage, however, the product must have a minimum acidity (pH less than 4.6) such as the acidity of orange juice (pH 2.8) as compared to the acidity of milk (pH 6.9) which is an unacceptable product for a HAAD package.

Current packaging machines utilized to form, fill and seal a carton to produce either an extended shelf life ("ESL") product or a shelf stable aseptic product, are often very large in that the area (also referred to as the "footprint") occupied is upwards to thirty square meters (usually 10 meters in length by 3 meters in width). The size of these machines present many problems for a dairy or other facility that may have a need for a packaging machine capable of producing aseptic or ESL products. The most obvious is the size, in that some dairies are just too small to accommodate such a machine. Next, a larger machine requires a greater amount of chemicals and other supplies to disinfect the machine after every production cycle. Further, a greater amount of labor is required too not only disinfect but maintain the machine in an operational manner.

BRIEF SUMMARY OF THE INVENTION

The present invention resolves the problems of the prior art by providing a packaging machine that is capable of producing an ESL product or an aseptic product but has a relatively small footprint as compared to typical aseptic, ESL or high hygiene machines. The present invention is able to accomplish this by creating a unique packaging machine that addresses the required parameters of sterilization capability and space. An alternative embodiment also provides for greater production while addressing the afore-mentioned parameters.

One aspect of the invention is a packaging machine for processing a carton blank received from a magazine and processed into a filled and sealed carton. The packaging machine includes an infeed sterilizer mechanism, a carton lift, a form and fill carousel and a sealing mechanism. The infeed sterilizer sterilizes an erected carton blank having an open top end and an open bottom end, and is disposed on a first level of the packaging machine. The carton lift lifts sterilized cartons from the infeed sterilizer mechanism on the first level to a second level. The form and fill carousel is located on the second level and has a central turret with a plurality of mandrels connected thereto, each of the plurality of mandrels is in flow communication with a product supply. The sealing jaw mechanism is disposed to receive a filled carton from a mandrel on the form and fill carousel and to seal an open end of the carton.

Another aspect of the invention is a process for forming, filling and sealing a carton on a packaging machine. Yet another aspect is a filling mandrel for filling a carton as it is lowered off of the mandrel.

Having briefly described this invention, the above and further objects, features and advantages thereof will be recognized by those skilled in the pertinent art from the following detailed description of the invention when taken in conjunction with the accompanying drawings.

BRIEF DESCRIPTION OF THE SEVERAL VIEWS OF THE DRAWINGS

Several features of the present invention are further described in connection with the accompanying drawings in which.

DETAILED DESCRIPTION OF THE INVENTION

Figure 1:
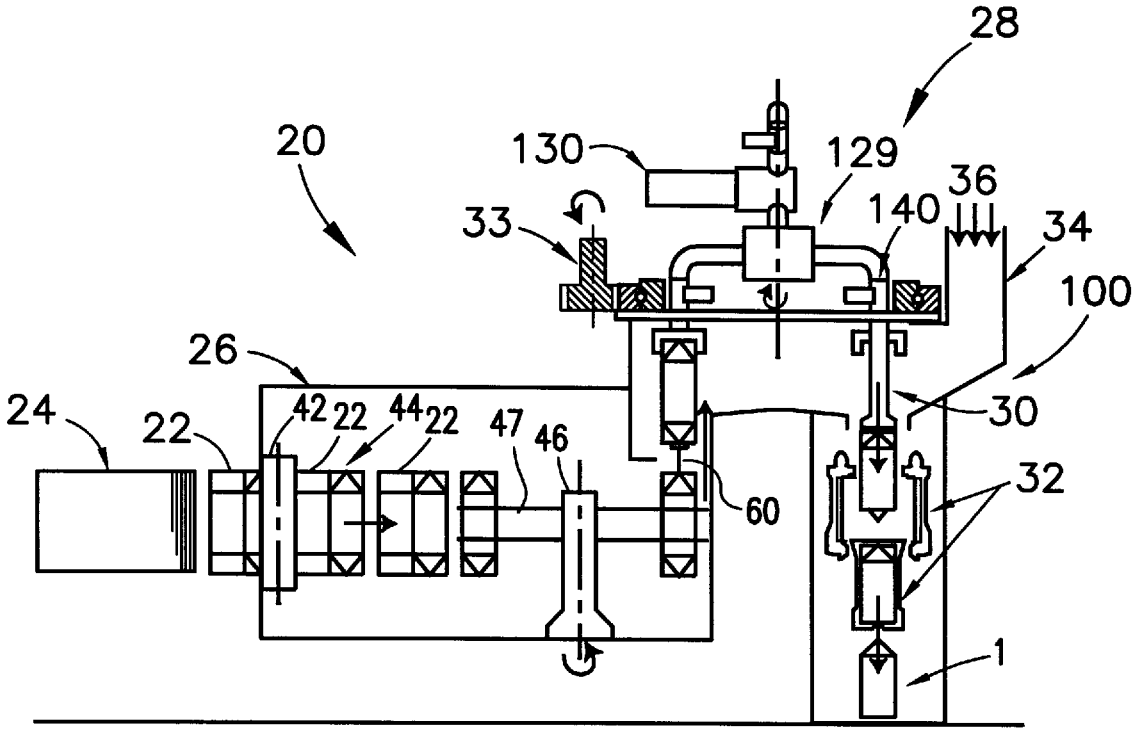
FIG. 1 is a schematic view of a preferred embodiment of the packaging machine of the present invention.

As shown in FIG. 1, a packaging machine is generally designated 20. The packaging machine 20 is provided with a series of carton blanks 22 from a magazine 24. The packaging machine 20 generally includes an infeed sterilizer 26, a form and fill carousel 28 with a plurality of filling mandrels 30 thereon, and a top sealing mechanism 32. The forming, filling and sealing operations are all performed within a sterile barrier 34 that is pressurized by a supply of sterile air 36 flowing therein. The sterile barrier forms an enclosed environment about the components of the packaging machine 20.

Figure 2:
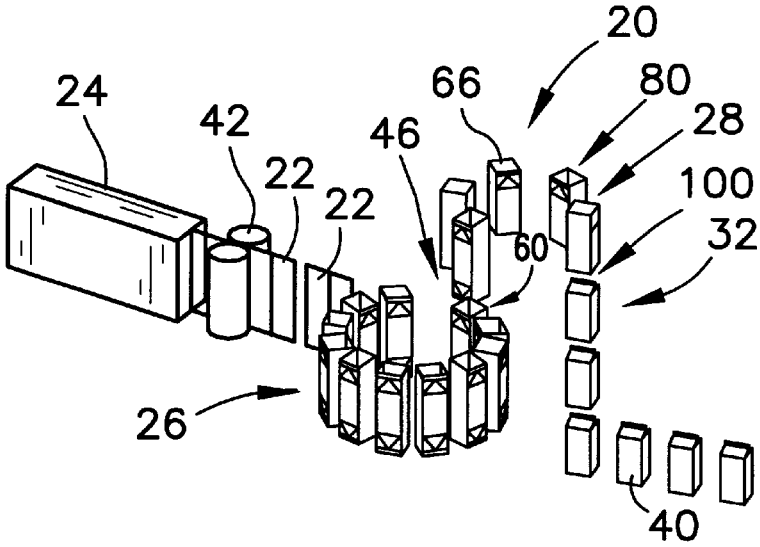
FIG. 2 a schematic top view of the progression of cartons on the packaging machine of FIG. 1.
Figure 3:
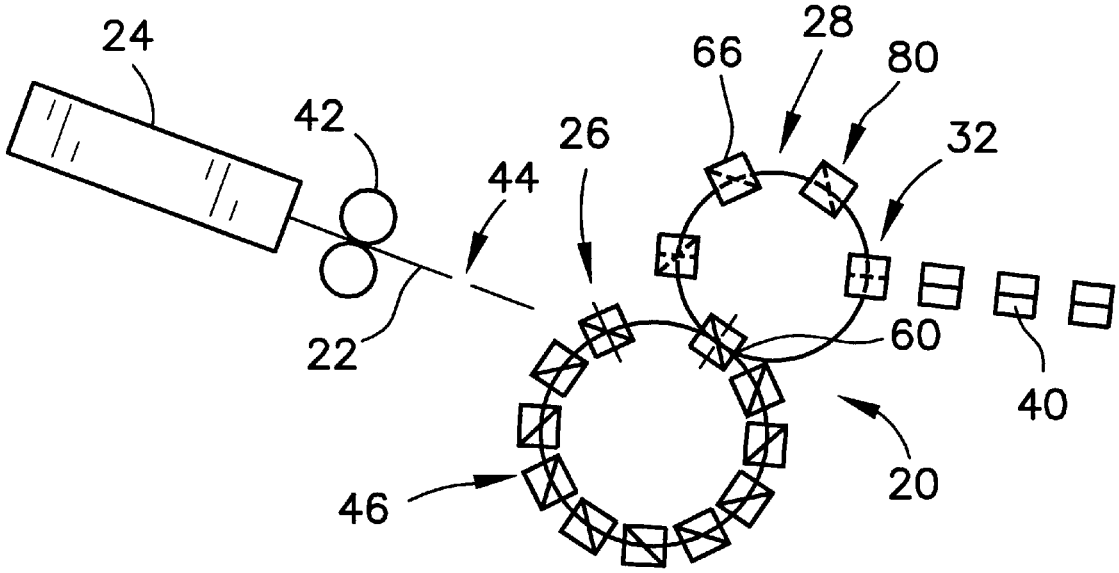
FIG. 3 is a schematic top plan view of FIG. 2.

The progression of carton blanks 22 to finished cartons 40 is shown in FIGS. 1–3, however, FIG. 2 provides an isolated view of the fabrication of the cartons 40 on the packaging machine 20. A nip roller 42 draws in the blanks 22 to the infeed sterilizer 26. The nip roller 42 overbreaks the blanks 22 reducing the blanks 22 memory/tendency to revert to a diamond shape. The exterior of the flat blanks 22 may be sterilized at an infeed conveyor 44 before being transferred to a sterilization carousel 46. Upon egress from the infeed conveyor 44, the flat carton blanks 22 are erected to a partially formed carton 40 and positioned within guides 47 on the sterilization carousel 46. The interior, as well as the exterior, of the cartons 40 may be sterilized during rotation on the sterilization carousel 46. A sterilant, such as gas-phase hydrogen peroxide may be flowed onto the carton while the cartons 40 are rotated on the sterilization carousel 46. A further explanation of the infeed sterilization is provided in co-pending U.S. patent application Ser. No. 09/141,716, filed on the same date of the present Application, entitled Infeed Sterilizer For A Packaging Machine, and hereby incorporated by reference. The infeed sterilizer 26 sterilizes each carton 40 in preparation of further forming and filling on the machine 20 which is performed on the carousel 28.

Figure 4:
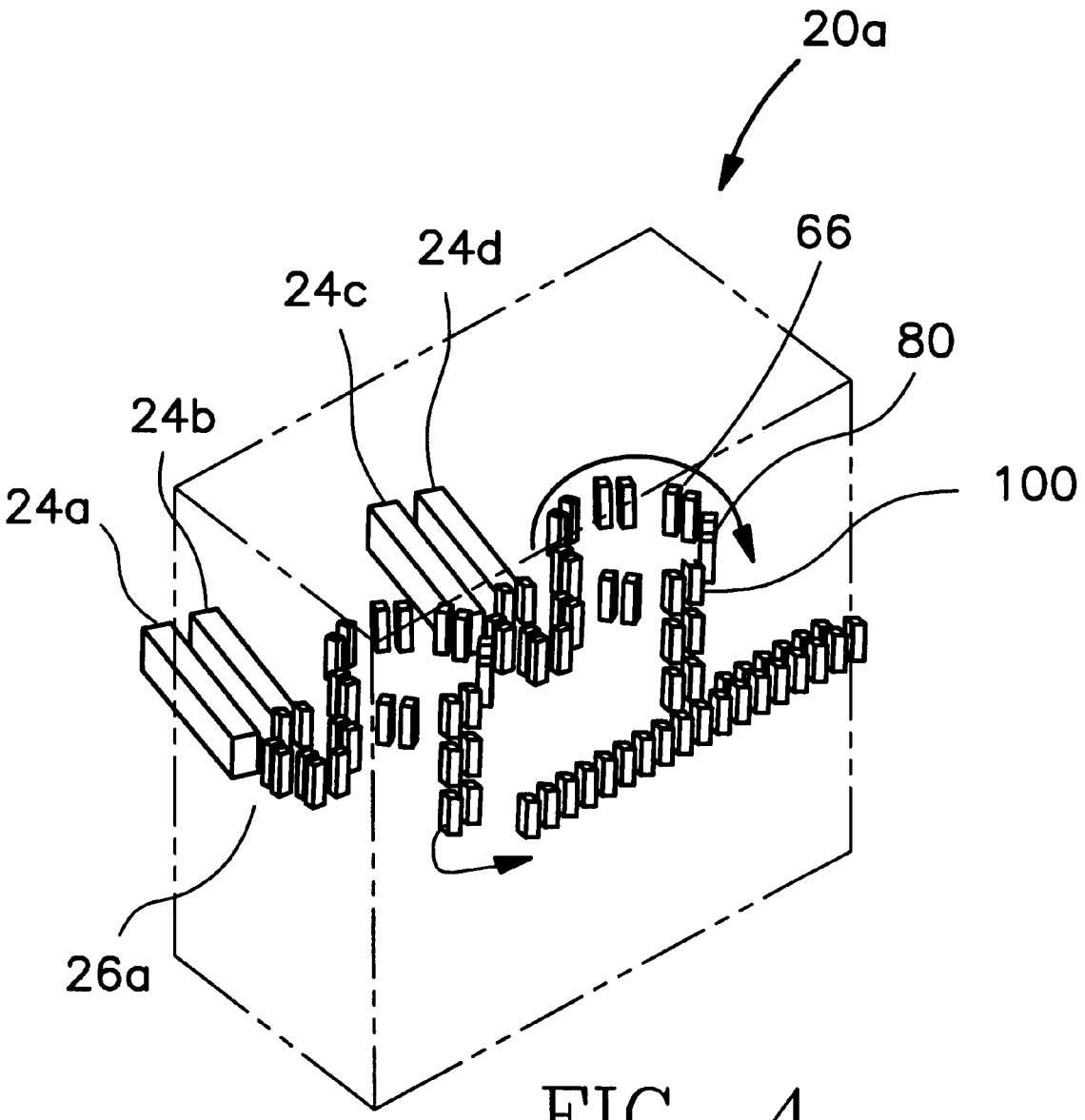
FIG. 4 is a schematic view of an alternative embodiment of the packaging machine of the present invention.
Figure 5:
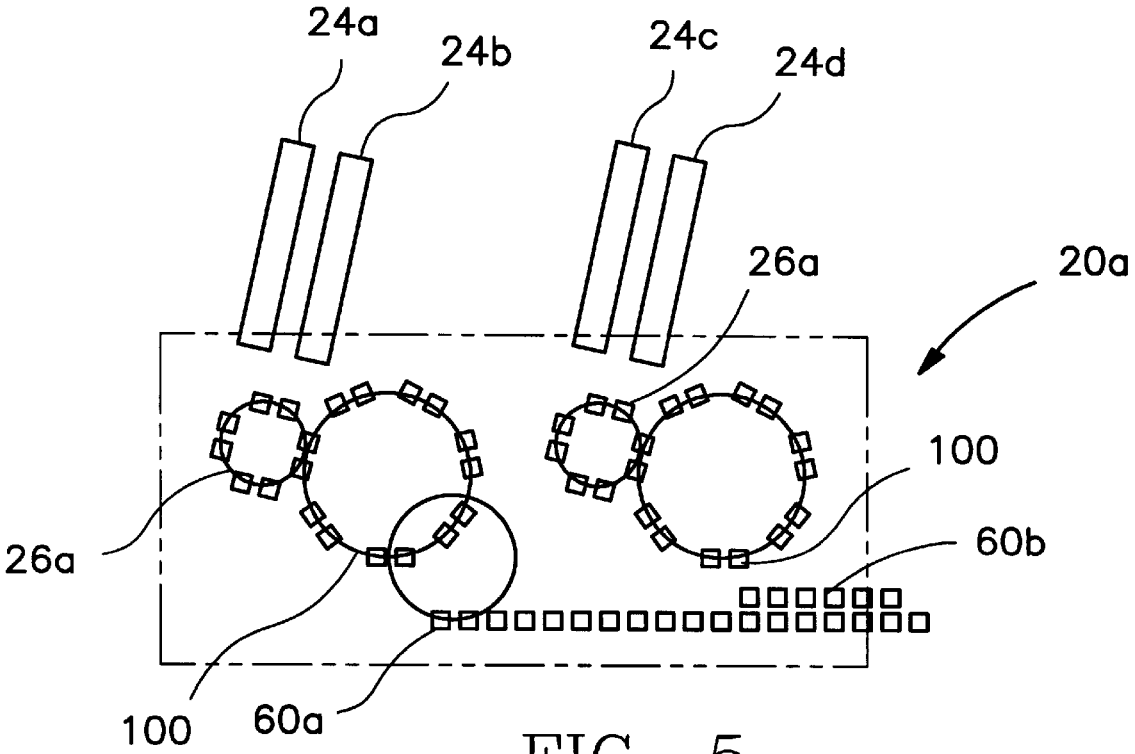
FIG. 5 is a schematic top plan view of FIG. 4.
Figure 6:
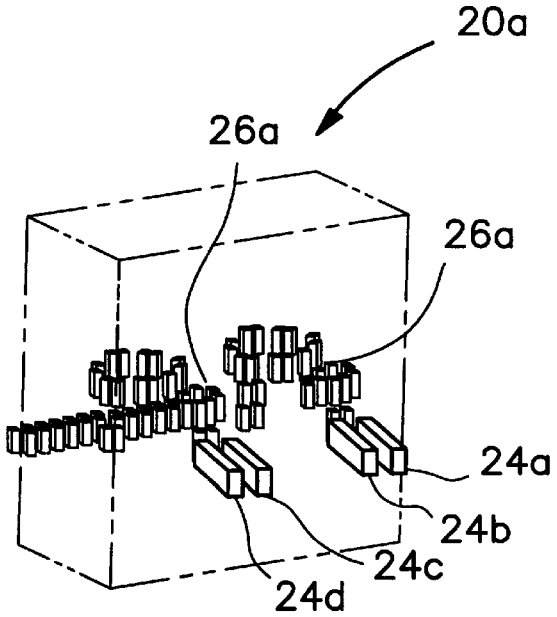
FIG. 6 a schematic top view of the progression of cartons on the packaging machine of FIG. 4.

An alternative embodiment of the machine 20*a* is illustrated in FIGS. 4–6. This variant is for a high-hygiene, high capacity, mini cross-section (the cross-section of the carton) filling machine. The infeed sterilizer 26 of FIG. 1 is replaced by a small carousel 26*a* for pre-folding of the top panels of the cartons 40 and also for application of a fitment to the carton. One possible fitment application machine is disclosed in U.S. Pat. No. 5,819,504, entitled Process And Apparatus For Applying Fitments To A Carton, which is hereby incorporated by reference.

The machine 20*a* of FIGS. 4–6 has two lines 60*a–b* that are fed by a plurality of magazines 24*a–d*. Each of the lines 60*a–b* simultaneously process two cartons 40 for increased production. After the small carousel, the machine 20*a* is substantially similar to the machine 20 of FIG. 1 except that two cartons 40 are processed simultaneously instead of one carton 40.

Figure 7:
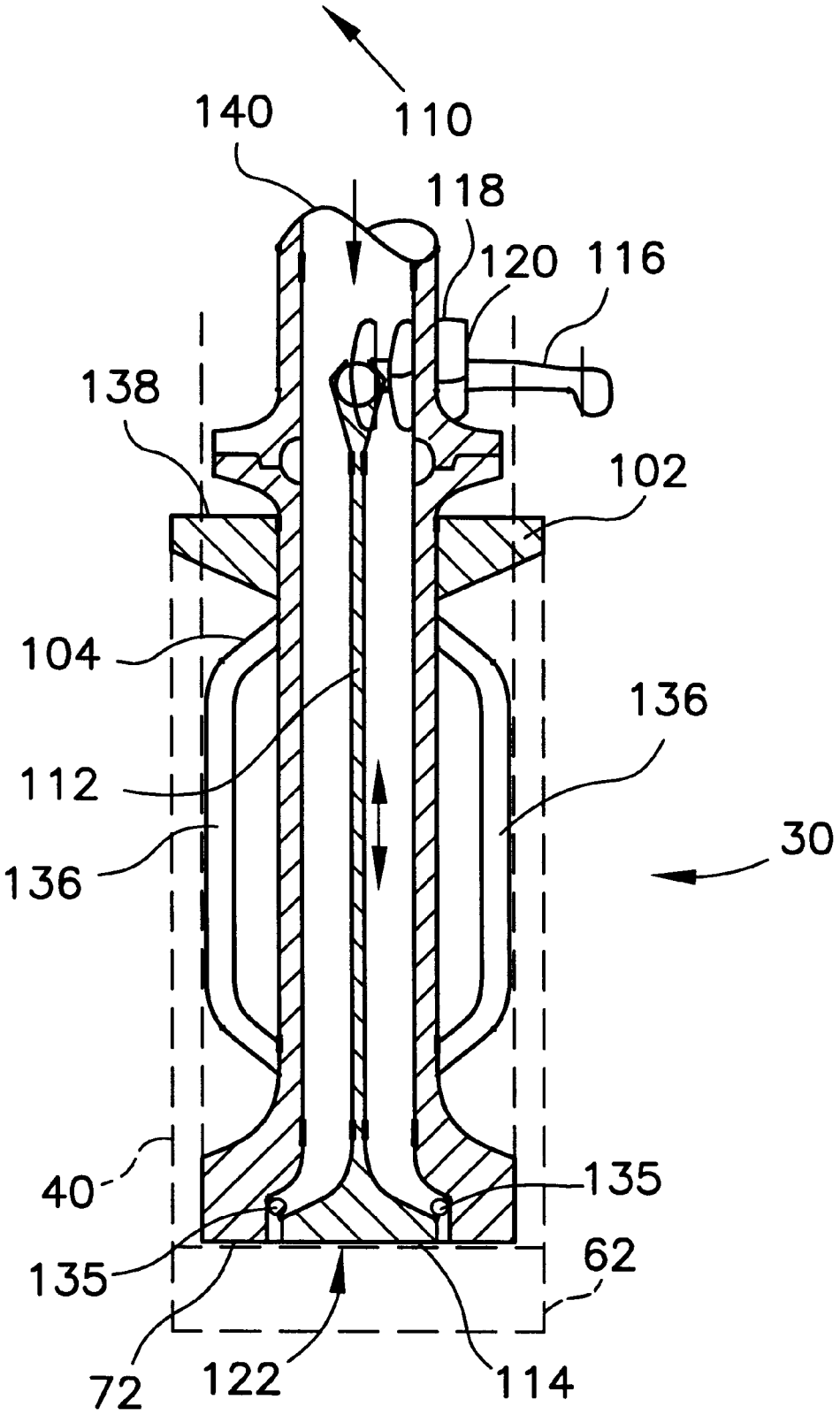
FIG. 7 is an isolated cross-sectional view of a filling mandrel of the present invention.
Figure 9:
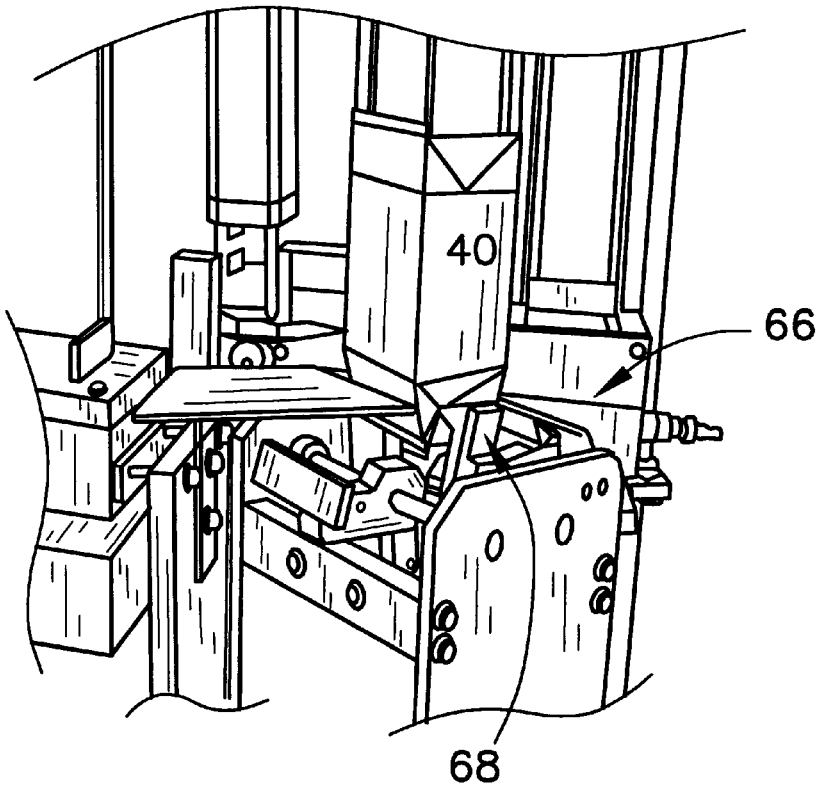
FIG. 9 is an isolated perspective view of a carton bottom pre-folding operation of the packaging machine of the present invention.
Figure 10:
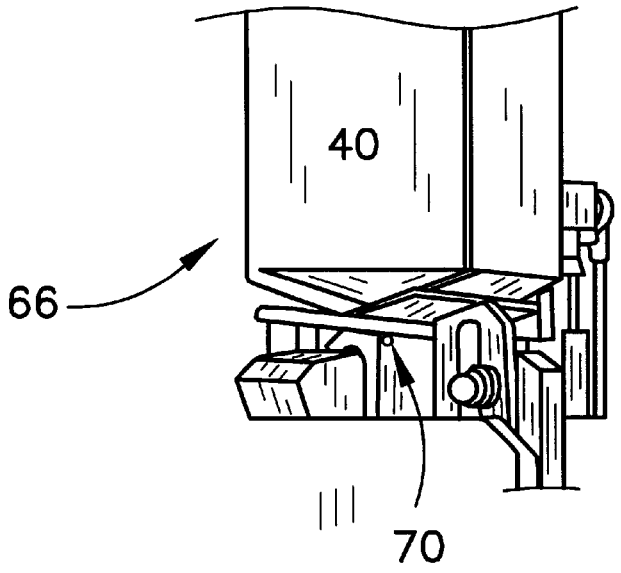
FIG. 10 is an isolated perspective view of a carton bottom folding operation of the packaging machine of the present invention.
Figure 11:
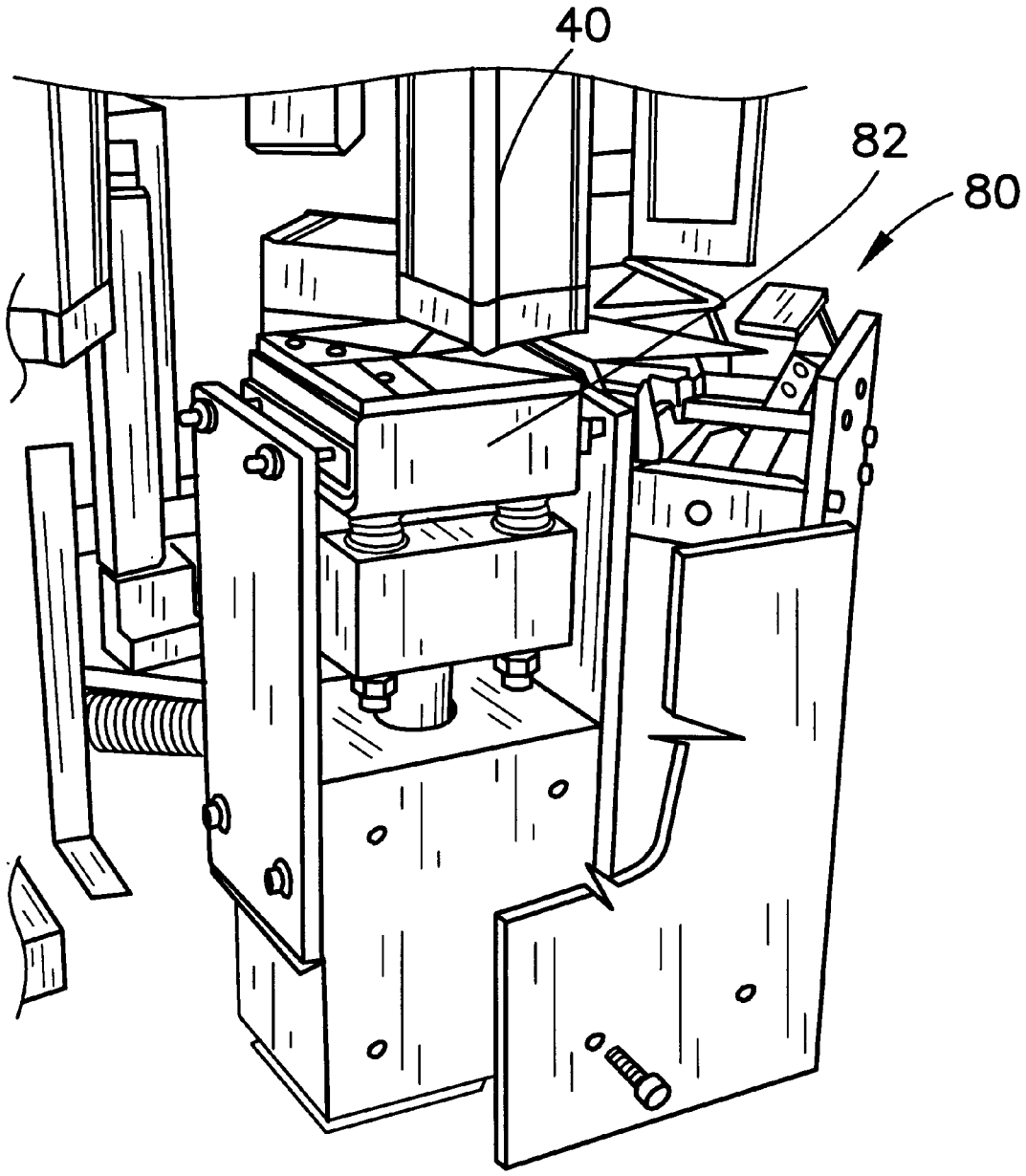
FIG. 11 is an isolated perspective view of a carton bottom sealing operation of the packaging machine of the present invention.

A carton lifter 60 transfers the sterilized carton blank 22 to the form and fill carousel 28. The lifter 60 places the carton 40 on a filling mandrel 30 for processing on the carousel 28. A preferred filling mandrel 30 is shown in FIG. 7 which will be described below. After each carton 40 is lifted onto the carousel 28, the carton 40, attached to a mandrel 30, is rotated about a central turret 129 to various stations for bottom forming and eventually filling. The carousel is driven by a drive pinion mechanism 33. The bottom panels 62 are heated and the top panels of each carton 40 may also be heated. A preferred heating method is to flow hot air onto the panels through a hot air blower, not shown. The hot air heats the thermoplastic coating of the carton to its melting temperature allowing for eventual chemical bonding for sealing purposes. Next, the carton bottom is folded at a folding station 66. A bottom folding station 66 is shown in FIGS. 9 and 10. At first arm mechanism 68 "breaks" the score lines by exerting a force on the sides of the bottom panels 62. Next, a folding plate arm 70 folds the bottom panels 62 inward about the "cap" area 72 of the filling mandrel 30. Next, the carton 40 is rotated to a bottom sealing station 80, as shown in FIG. 11, where a sealing plate 82 presses against the bottom panels 62 and the cap area 72 thereby heat sealing the bottom panels together by chemical bonding of the thermoplastic coatings. The sealing plate 82 also acts to cool the bottom panels 62 lowering the temperature of the thermoplastic coating to below its melting temperature. A preferred thermoplastic coating is polyethylene. Once the carton bottom is formed and sealed, the carton 40 is ready for filling.

At a filling and top sealing station 100 the carton is filled with a desired product such as milk or juice, as it is pulled off of the filling mandrel 30. Again, referring to FIG. 7, the filling mandrel 30 has a body 102 having a length and width capable of being placed within a carton 40. The interior of the body 102 is defined by a fill tube/cavity 104 that extends through the body 102 and is in flow communication with a product supply 110. A stem 112 connected to a valve 114 are placed within the fill tube 104. The stem valve complex is connected to an actuator 116 which may be controlled by a Programmable Logic Circuit ("PLC") as described in U.S. Pat. No. 5,706,627 for a Control System For A Packaging Machine which relevant parts are hereby incorporated by reference. The actuator 116 connects to the stem 112 through an aperture 118 in the body 102 near the top of the fill tube 104. An elastomer seal 120 seals the remainder of the aperture 118 about the actuator 116. The flow of product to the fill tube 104 is controlled by a metering pump 130 mounted on the turret 129 of the form and fill carousel 28. The metering pump 130 ensures that the proper amount of product is provided for each carton through an outlet 122 in the body 102 at an outlet end of the fill tube 104.

During the filling procedure, a carton 40 that has been previously bottom formed on the mandrel 30 is rotated to a filling position and lowered along a longitudinal pathway. At the end of the downward movement, the open end, and more likely than not the top end, is sealed together to form a finished product. The top sealing is accomplished by the top sealing mechanism 32 which will be described in more detail below. As the carton 40 is lowered from the filling mandrel 30, the actuator 116 opens the valve 114 allowing the product to flow from the outlet 122 into the carton 40. This so-called bottom-up filling substantially reduces the amount of foaming and splashing of product, in particular milk products. Once the carton 40 is filled with the product, the actuator 116 closes the valve 114 to prevent dripping of the product on the seal area of the carton 40. The body 102 has a recess area 135 for receiving a portion and mating with the upper surface of the valve 114 to create a tight seal between the body 102 and the valve 114.

The filling mandrel 30 may have a plurality of carton guide rods 136 for positioning of the carton 40 on the mandrel 30. The filling mandrels 30 may be mounted to the form and fill carousel 28 via mounting flange 138. A plurality of peripheral piping 140 connects the fill tube 104 to the metering pump 130 and also to the product supply 110.

Figure 7A:
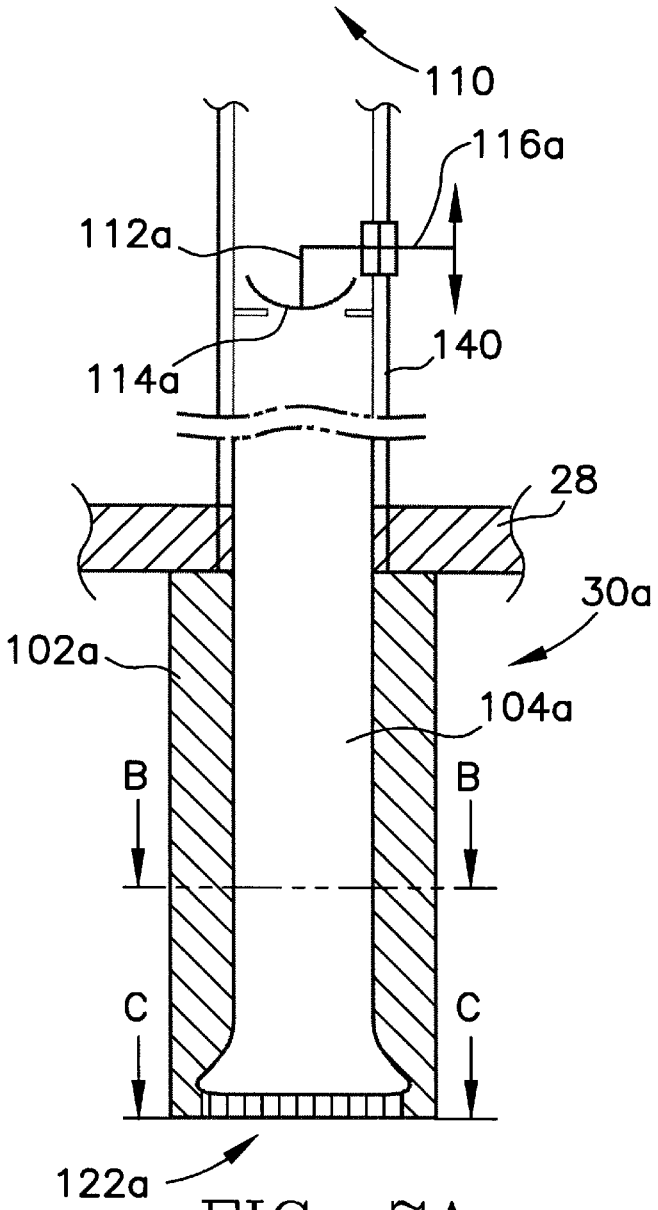
FIG. 7A is an isolated cross-sectional view of an alternative embodiment of a filling mandrel of the present invention.
Figure 7C:
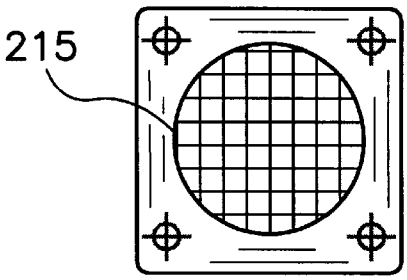
FIG. 7C is a cross-sectional view along line C—C of FIG. 7A.
Figure 7B:
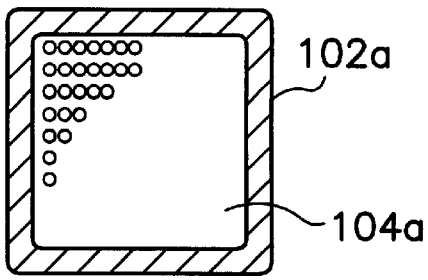
FIG. 7B is a cross-sectional view along line B—B of FIG. 7A.

An alternative filling mandrel is illustrated in FIG. 7A–7C. In this embodiment, the filling mandrel 30*a* is similar to the filling mandrel 30 of FIG. 7. The filling mandrel 30*a* has a body 102*a* surrounding a fill tube 104*a* which is in flow communication with the metering pump 130 and the product supply 110. In this embodiment, the valve 114*a*, the stem 112*a* and the actuator 116*a* are all disposed upstream from the fill tube 104*a*, and are preferably located within the piping 140. The outlet 122*a* is covered by a screen 215 which also may be a perforated plate that uses surface tension to prevent the product from dripping and causing sealing problems.

As a complement to the filling mandrel, a top sealing mechanism 32 seals the open end of the carton 40 after it is lowered from the filling mandrel 30. A more detailed explanation of the top sealing mechanism is provided in co-pending U.S. patent application Ser. No. 09/141,696, filed on an even date herewith the filing of the present application, entitled Vertical Sealing Assembly For A Packaging Machine, and which is hereby incorporated by reference in its entirety.

Figure 8:
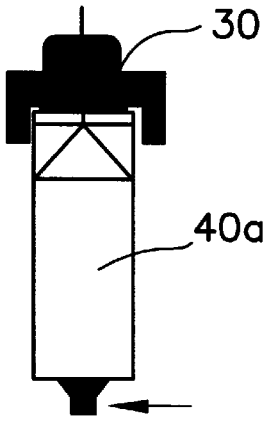
FIG. 8 is an isolated view of a top sealing mechanism of the packaging machine of the present invention at a first point in time.
Figure 8A:
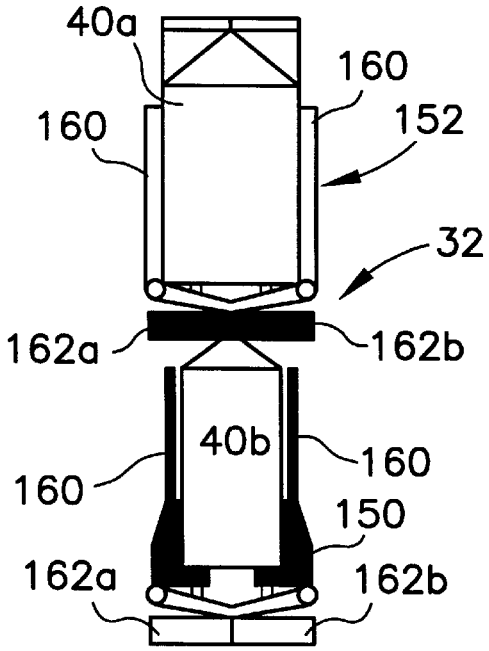
FIG. 8A is an isolated view of a top sealing mechanism of the packaging machine of the present invention at a second point in time.
Figure 8B:
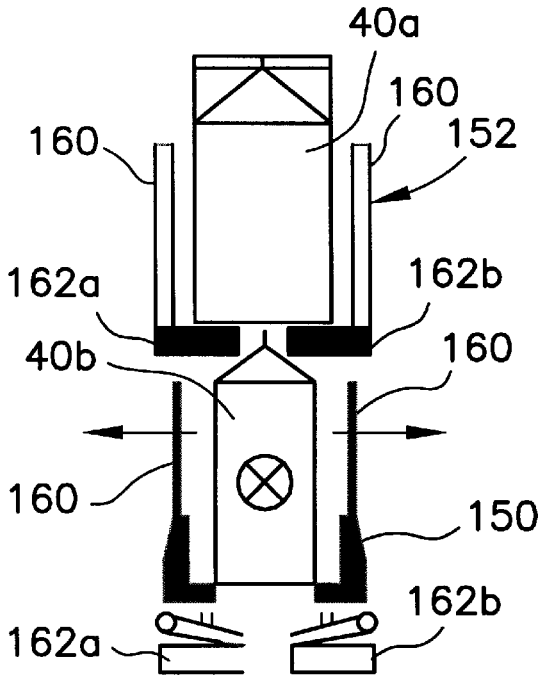
FIG. 8B is an isolated view of a top sealing mechanism of the packaging machine of the present invention at a third point in time.

Although other top sealing mechanisms are applicable, a preferred top sealing mechanism 30 is described and illustrated in the figures, particularly FIGS. 8–8B. The top sealing mechanism 32 includes a first jaw assembly 150 and a second jaw assembly 152 which operate in a continuous loop to grasp cartons 40 and seal the open end of the cartons 40. Each jaw assembly 150 and 152 is composed of a plurality of side grippers 160 and sealing jaws 162*a–b*. As one jaw assembly grips a carton 40*a*, newly filled by and lowered from the filling mandrel 30, the sealing jaws 162*a–b*, which move in tandem with the side grippers 160, engage each other to seal the open end of the immediate predecessor carton 40*b* from the filling mandrel 30. In this manner, as one carton 40*a* is acquired by the second jaw assembly 152, a predecessor the carton 40*b*, which was acquired by the first jaw assembly 150, has its open end sealed by the jaws 162*a–b* of the second jaw assembly 152. Once the open end of the carton 40*b* is sealed, this is usually the top end, the carton 40*b* is ready for further distribution. The first jaw assembly 150 then releases the carton 40*b* and begins its movement upward on the continuous loop to obtain a subsequent carton 40*c* to carton 40*a*. Simultaneously, the second jaw assembly 152 lowers carton 40*a* to the position previously occupied by the carton 40*b*, in order to seal the open end of the carton 40*a*.

During the filling and sealing operations, sterile air is flowed downward from the sterile air supply 36 to exclude microorganisms from contaminating the cartons 40. A description of a possible sterile air supply system is disclosed in U.S. Pat. No. 5,979,514, filed on Jan. 28, 1998, entitled Hygienic Fill System For A Packaging Machine which pertinent parts are hereby incorporated by reference.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims:

I claim as my invention:

1. A packaging machine for processing a carton blank received from a magazine into a filled and sealed carton, the packaging machine comprising:

an infeed sterilizer carousel for moving the carton blank in a first generally horizontal plane and for sterilizing an erected carton blank having an open top end and an open bottom end, the infeed sterilizer carousel disposed on a first level;

a carton lift for lifting the sterilized cartons from the infeed sterilizer carousel through a first generally vertical plane from the first level to a second level;

a form and fill carousel having a central turret rotatable in a second generally horizontal plane parallel to and spaced from the first generally horizontal plane, the central turret having a plurality of filling mandrels connected thereto, each of the plurality of filling mandrels in flow communication with a product supply; and a sealing jaw mechanism disposed to receive a filled carton from a mandrel on the form and fill carousel to seal an open end of carton.

2. The apparatus according to claim 1 wherein each of the filling mandrels comprises:

a body having a first end and a second end, the second end defining a cap area having an outlet;

a fill tube disposed within the body, the fill tube in flow communication with the outlet on one end and a supply of product on the other end through a flow pipe; and a valve connected to a stem, the valve disposed within the flow pipe to seal off the flow of product from the product supply, the stem disposed within the flow pipe and connected to an actuator.

3. The apparatus according to claim 2 wherein the actuator of each of the filling mandrels is in communication with a PLC.

4. The apparatus according to claim 1 wherein each of the filling mandrels comprises:

a body having a first end and a second end, the second end defining a cap area having an outlet;

a fill tube disposed within the body, the fill tube in flow communication with the outlet on one end and a supply of product on the other end; and a valve connected to a stem, the valve disposed to seal the outlet, the stem disposed within the fill tube and connected to an actuator.

5. The apparatus according to claim 1 wherein the infeed sterilizer carousel comprises a sterilization carousel having a plurality of carton guides for accepting and holding erected carton blanks while rotating about a turret, the infeed sterilizer carousel also comprising means for sterilizing the erected carton blanks with a sterilant.

6. The apparatus according to claim 1 further comprising means for processing two cartons simultaneously on the packaging machine.

7. The apparatus according to claim 1 further comprising means for introducing sterile air into an enclosed environment, the enclosed environment containing at least the infeed sterilizer carousel, the form and fill carousel and the sealing jaw mechanism.

8. The apparatus according to claim 1 further comprising a nip roller disposed between the infeed sterilizer carousel and the magazine.

9. The apparatus according to claim 1 the sealing jaw mechanism comprises a first jaw assembly having a first jaw with a first plurality of carton grippers disposed above the first jaw, and a second jaw assembly having a second jaw with a second plurality of carton grippers disposed above the second jaw, the first and second sealing jaw assemblies operating along a continuous loop.

* * * * *